US005259995A

United States Patent [19]

Matalis

[11] Patent Number: 5,259,995

[45] Date of Patent: Nov. 9, 1993

[54] VAPOR PRESSURE DEVICE

[75] Inventor: Thomas V. Matalis, Chicago, Ill.

[73] Assignee: Liquid Carbonic Industries Corporation, Oak Brook, Ill.

[21] Appl. No.: 41,516

[22] Filed: Apr. 1, 1993

Related U.S. Application Data

[63] Continuation of Ser. No. 785,025, Oct. 30, 1991, abandoned.

[51] Int. Cl.[5] ..... B01F 3/04

[52] U.S. Cl. ..... 261/107; 128/204.13

[58] Field of Search ..... 128/204.13, 203.25; 261/107, 105, 99

[56] References Cited

U.S. PATENT DOCUMENTS

| | | | |
|---|---|---|---|
| 2,206,688 | 7/1940 | Bloomheart | 128/204.13 |
| 2,551,114 | 5/1951 | Goodard | 261/99 |
| 2,812,762 | 11/1957 | Jordan et al. | 128/204.13 |
| 3,583,635 | 6/1971 | Lemelson . | |
| 4,365,952 | 12/1982 | Ohmukai et al. | 261/107 |
| 4,708,831 | 11/1987 | Elsworth et al. | 128/204.13 |
| 4,818,447 | 4/1989 | Iwasaki . | |
| 4,825,661 | 5/1989 | Holtzapple et al. . | |
| 4,888,037 | 12/1989 | Bandyopadhyay et al. . | |
| 4,903,761 | 2/1990 | Cima . | |
| 5,004,489 | 4/1991 | Rotman et al. . | |

OTHER PUBLICATIONS

*Glass To Metal Sealing: Improved Yields And Quality Using Nitrogen Based Atmospheres* by J. Schmidt and J. Carter, International Microelectronics Symposium (ISHM 84).

*Improved Glass To Metal Sealing Through Furnace Atmosphere Composition Control* by W. Yext and B. Shook of Air Products, and W. Katzenberger and R. Michaleh from Elecpac Div. of Wilbrecht Electronics presented at 33rd Electronics Components Conference, Orlando, Fla., May 1983.

Advanced Gas Moisturizing System for Ceramic Processing Applications by F. W. Giacobbe.

*Primary Examiner*—Tim Miles

*Attorney, Agent, or Firm*—Lee, Mann, Smith, McWilliams, Sweeney, & Ohlson

[57] ABSTRACT

A humidifying device or vapor pressure regulator which controls subsaturation vapor pressures of liquids using a wick-like structure through which a carrier gas is blown to evaporate the liquid.

6 Claims, 1 Drawing Sheet

VAPOR PRESSURE DEVICE

This application is a continuation of application Ser. No. 785,025, filed Oct. 30, 1991, now abandoned.

BACKGROUND OF THE INVENTION

In the atmosphere control industry, there are many occasions where mixtures of gases and liquids in a vapor form are necessary for various chemical processes. However, there have been problems in providing control of the vapor pressure of the liquid or liquids within the gas or gases. When handling small volumes of liquids, surface tension becomes an important factor. Spraying the liquid into an unsaturated gas becomes difficult from the spray nozzle design and the uniformity of the vapor pressure of the liquid obtained throughout the gas. Thermally vaporizing the liquid or liquids can cause problems because of thermal degradation to the liquids, safety considerations and the general expense of control.

Heretofore, a partial vapor pressure was provided by bubbling a partial stream of the carrier gas through the liquid and then combining the partial stream with the main stream of the carrier gas. This is referred to as sparging. This process did not provide proper control of the amount of liquids, for example water, added to the gas since the amount of water added using this process may change depending on ambient temperature, pressure control and water level control. See *Glass To Metal Sealing: Improved Yields And Quality Using Nitrogen Based Atmospheres* by Jerome J. Schmidt and Jerry Carter, International Microelectronics Symposium (ISHM 84) which uses an atmosphere flow control system including bubbling nitrogen through distilled water; U.S. Pat. No. 4,888,037 issued Dec. 19, 1989, which discloses a process for sealing glass to metal using a humidification method of bubbling gas through water; and *Improved Glass To Metal Sealing Through Furnace Atmosphere Composition Control* by Walter F. Yext and Bruce J. Shook of Air Products, and Wayne S. Katzenberger and Robert Michaleh from Elecpac Division of Wilbrecht Electronics, Inc., presented at the 33rd Electronics Components Conference in Orlando, Fla., May 1983, which deals with improved processes for more precise control over furnace atmosphere composition and which provides humidity in a nitrogen gas flow by bubbling the gas through a water vaporizer. This prior art approach to providing partial vapor pressure in gas streams has been extremely difficult to control and has caused many problems.

SUMMARY OF THE INVENTION

Subsaturation vapor pressures of various liquids can be easily controlled by using a hollow wick-like structure and volumetrically controlling the flow of the liquid to be vaporized. The carrier gas for the vapor is blown through the hollow wick thereby evaporating the liquid. This may be done, for example, by using a sintered porous tube covered with a cloth wick structure. The liquid to be evaporated or vaporized, for example water, is fed onto the wick surface using a manifold with multiple orifices on the side of the manifold touching the wick. The gas, for example nitrogen, is blown through the sintered porous tube and evaporates the water as the gas is blown through the wick. The water is metered by use of a rotometer or any other metering device. The vaporized liquid and carrier gas may then be directed for use in a furnace or the like.

Since the evaporator gas is always acting below saturation, problems of recombination and condensation that occur while handling the saturated partial vapor carrier stream prior to combining with the main stream are avoided. Changes in vapor concentration may be accomplished by varying the liquid flow rate rather than varying two gas flow rates. Lower vapor concentrations can be achieved and maintained by use of this method than by the bubbler method. Lower vapor concentrations can also be achieved and maintained by use of this method than by use of spray nozzles or thermal evaporators.

The humidifying device or vapor pressure regulator of this invention works by evaporation of the liquid or liquids into a gas stream, or a stream of gases, by passing the gases through a wick-like structure which is wetted with the liquid or liquids to be evaporated. The capillary action of the liquids in the wick help spread the liquids throughout the structure of the wick. The carrier gas or gases can then easily transform the liquids into a vapor state by limiting the volume of the liquid or liquids such that the vapor concentrations produced are at or below the saturation point of the gas or gases at their temperature. After evaporating the liquid, the vapor pressure of the components can be easily controlled. By using a continuous metered flow of liquids and gases, it is possible to readily obtain the desired vapor pressure and to change the vapor pressure with relative ease.

BRIEF DESCRIPTION OF THE DRAWINGS

FIG. 3 is a diagrammatic view showing the path of the gases and liquid and the discharge to a furnace or the like.

DETAILED DESCRIPTION OF THE PREFERRED EMBODIMENT

Figure 1:
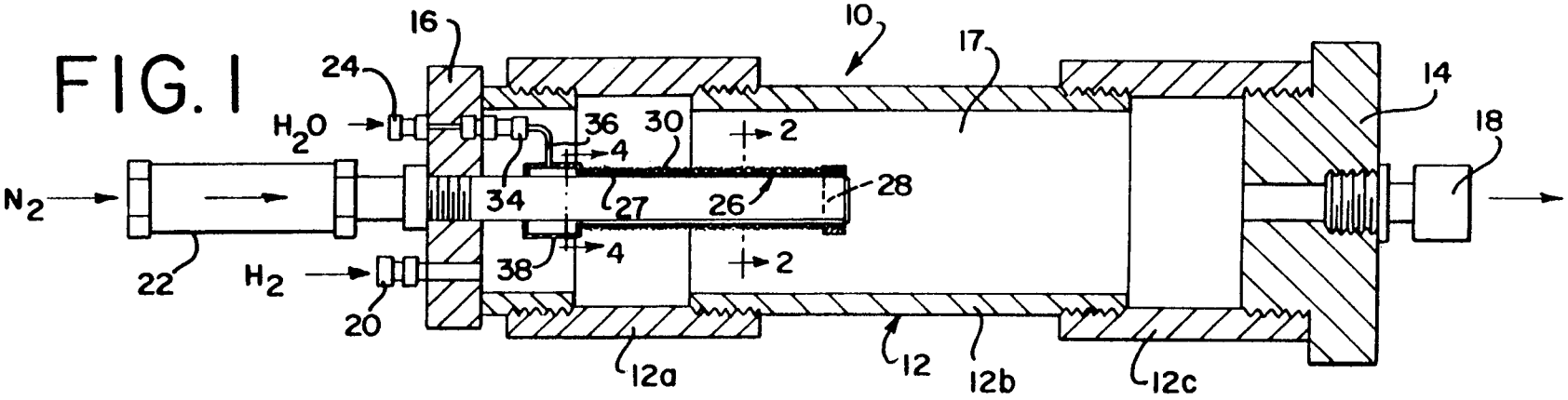
FIG. 1 is a partial sectional view of the partial vapor pressure device of this invention showing the sintered porous tube and cloth wick structure in diagrammatic form.
Figure 2:
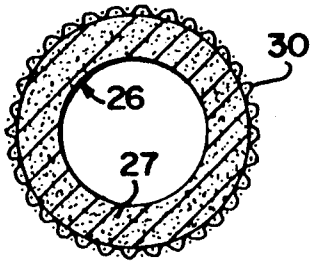
FIG. 2 is a sectional view taken along the line 2—2 of FIG. 1.

The humidifying device or vapor pressure regulator 10 of this invention, as shown in FIG. 1, is situated in a three part casing 12 having units 12*a*, 12*b* and 12*c* which are threadedly joined together to provide a single unit. No particular importance is placed on this construction. Any casing of suitable size would be useable. The casing 12 is closed and sealed at both its ends by threadedly attached plugs 14 and 16. The casing 12 and plugs 14 and 16 form a hollow chamber 17. Passing through the plug 14 is a discharge line 18 which is threadedly attached to the plug 14. The plug 16 at the other end of the casing 12 includes several inlet ports to allow the introduction of gases and liquid into the chamber 17. Line 20 is designed in this particular construction for the introduction of hydrogen gas. Line 22 is designed to carry nitrogen gas and line 24 is designed to carry a liquid, in this case, water. Referring more specifically to line 22, it can be seen in FIG. 1 that this is a large diameter line which is threadedly received in the plug 16 and is connected to a sintered tube 26. The sintered tube 26 is of conventional construction including porous side-walls 27, which allow the gas passing through the line 22 and into the tube 26 to pass outwardly through the side walls 27. The end of the tube 26 is sealed by a plug 28. Surrounding the side walls 27 of the sintered tube 26 is a tubular cloth wick 30. The wick 30 may be made of cotton cloth, felt or various other moisture absorbing fabrics and materials, which will not chemically react with the liquid.

In operation, the liquid enters the line 24, passes through the entry plug 16 and into the connector 34. From the connector 34, the liquid enters a line 36 which goes into an annular manifold 38 which extends around the tube 26. The manifold 38 is connected to the wick 30 and through holes (31) which allow the liquid to be fed to the entire surface of the wick 30 and allow the liquid to seep into the wick surface and along the surface of the sintered tube 26. The surface of the sintered tube being porous allows the gas (nitrogen) entering the line 22 to pass through the walls of the sintered tube 26 and through the wick 30 where the gas picks up an amount of the liquid and then passes into the interior of the casing 12. The casing 12 is sealed so that the vapor laden gas then exits through the discharge line 18. In the specific use of glass to metal sealing, an amount of hydrogen gas was desirable. The hydrogen gas enters through the line 20 into the interior of the casing 12 where it mixes with the liquid laden nitrogen and exits through the discharge line 18.

Figure 3:
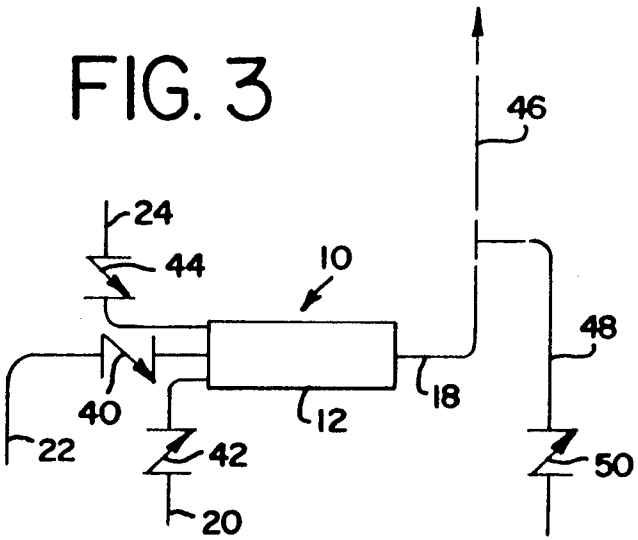
Figure 4:
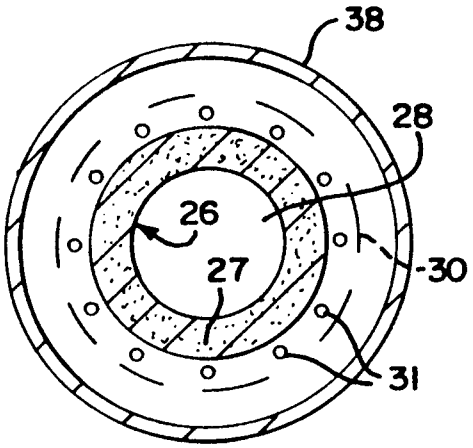
FIG. 4 is a sectional view taken along the line 4—4 of FIG. 1.

Referring now to the schematic in FIG. 3, it can be seen that the nitrogen gas enters through the line 22 and passes through a valve 40 (not shown in FIG. 1) and into the casing 12. In like fashion, the hydrogen gas enters through the line 20, through valve 42 and into the casing 12. The liquid enters the casing 12 through the line 24 and valve 44. The valves 40, 42 and 44 provide control capabilities for the direction of flow of gases and liquid. Valves and measuring devices (not shown) are also provided in each of the gas and liquid lines to control and measure the rate of flow of the liquid and gases. The mixing previously described then takes place and the nitrogen/hydrogen/liquid mixture passes out through the discharge valve 18 to a furnace line 46. An emergency line 48 is provided to add nontreated gas to the process in case of emergency.

The form of the wick 30 does not have to be the same as shown, but could be constructed in many different manners as long as the majority of the carrier gas in line 22 passes through the wick to evaporate the fluid. The amount of gas which is needed is determined by the saturation properties of the gas-vapor combination.

As an alternative construction, a sintered plate (not shown) could be located in the chamber 17 so as to divide the chamber into two portions. The wick could be located on either side of the sintered plate, but would preferably be located in the second portion of the chamber 17 and adjacent the sintered plate. The gas would be fed into the first portion of the chamber 17 and would pass through the sintered plate and the wick evaporating the liquid.

As an example of the specific use of the humidifying device or vapor pressure regulator of this invention, it may be used in the glass to metal sealing process. There are three separate steps in this process. These are:

1. Decarburization. Removal of carbon from the surface layers of the alloy metal parts to prevent degassing during further processing. This requires an oxide reducing and carbon oxidizing atmosphere. The vapor pressure regulator of this invention provided such an atmosphere comprising 5% hydrogen, 0.5% water and 94.5% nitrogen.
2. Oxidizing. Formation of a surface layer of certain iron oxides over the decarburized metal surface in order to allow formation of a strong metallurgical bond during sealing. This requires a controlled oxidizing atmosphere. The vapor pressure regulator of this invention provided such an atmosphere comprising 0.4% hydrogen, 1% water and 98.6% nitrogen.
3. Sealing. Formation of the bond between the glass and metal oxide while controlling the oxidation reduction potential to prevent glass wicking and proper glass to metal meniscus. The sealing atmosphere required for this step was provided by the vapor pressure regulator of this invention comprising 1% hydrogen, 0.4% water and 98.6% nitrogen.

Such a furnace is also used to copper braze assemblies which requires an iron oxide reducing atmosphere, without it being so reducing as to allow braze flashing over the metal. The decarburizing atmosphere is useful for this process.

It can be seen, therefore, that by controlling the amount of gases and liquid that pass through the vapor pressure regulator 10 of this invention, an operator can select an atmosphere useful for various processes in various types of furnaces with much closer control of the atmosphere than can be provided by using the ordinary bubbling method.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed:

1. An industrial vapor pressure device for providing a controlled amount of liquid vapor in a gas stream being fed to a process furnace comprising:
   - a sealed casing having inlet ports and an outlet port;
   - a means for introducing a gas stream into said casing through one of said inlet ports, said means including a porous member within said casing through which said gas passes; and
   - a means for introducing a controlled amount of liquid into said casing through another of said inlet ports, said means including a manifold having a plurality of orifices and a wick through which said liquid passes in fluid communication with said orifices, said manifold and said wick being located within said casing;
   - said wick being located adjacent to and in operable contact with said porous member whereby said gas passing through said porous member also passes through said liquid laden wick thereby providing a controlled amount of said liquid in said gas before said gas passes through said outlet port.

2. The vapor pressure device of claim 1 wherein said manifold is annular and extends around said porous member.

3. The vapor pressure device of claim 1 wherein said porous member comprises a sintered tube connected to said means for introducing a gas stream and located in said casing.

4. The vapor pressure device of claim 3 wherein said wick is positioned operatively adjacent and at least partially surrounding said sintered tube whereby the gas passes through said sintered tube and through said wick.

5. Industrial pressure device for providing a controlled amount of vapor in a gas stream being fed to a process furnace comprising:

a sealed casing having a liquid inlet port and a gas inlet port at one end and an outlet port at the other end;

a liquid carrying line connected to said liquid inlet port and passing therethrough into the interior of said casing;

a manifold having a plurality of orifices, said manifold located within said casing and connected to said liquid carrying line;

a liquid distributing tubular wick in fluid communication with said orifices in said manifold and adapted to absorb liquid therefrom;

a gas carrying line connected to said gas inlet port and passing therethrough into the interior of said casing; and a sintered tube connected to the end of said gas carrying line and located within said casing and within and in contact with said tubular wick whereby said gas passes through said sintered tube and through said liquid laden wick to provide a controlled amount of said liquid in said gas before said gas passes through said outlet port.

6. The vapor pressure device of claim 5 wherein said manifold is annular and extends around said sintered tube.

* * * * *